United States Patent [19]

Goudal

[11] 4,011,148

[45] Mar. 8, 1977

[54] METHOD OF ELECTROLYSIS

[75] Inventor: Philippe Goudal, Bures sur Yvette, France

[73] Assignee: Electricite de France (Service National), Paris, France

[22] Filed: Jan. 14, 1976

[21] Appl. No.: 648,959

Related U.S. Application Data

[63] Continuation-in-part of Ser. No. 569,773, April 21, 1975, abandoned.

[30] Foreign Application Priority Data

| | | |
|---|---|---|
| Mar. 11, 1975 | United Kingdom | 10184/75 |
| Apr. 3, 1975 | Belgium | 155045 |
| Mar. 21, 1975 | Germany | 2512575 |
| June 6, 1975 | Italy | 49945/75 |
| Mar. 25, 1975 | Spain | 436000 |
| Apr. 24, 1975 | Switzerland | 5246/75 |

[52] U.S. Cl. ..... 204/129

[51] Int. Cl.[2] ..... C25B 1/02

[58] Field of Search ..... 204/129

[56] References Cited

FOREIGN PATENTS OR APPLICATIONS 119,885 12/1918 United Kingdom ..... 204/129

*Primary Examiner*—R. L. Andrew

*Attorney, Agent, or Firm*—Michael Klotz

[57] ABSTRACT

A method of electrolysis is described in which the electrolysis is powered by electricity generated from the energy released by the reaction between at least one of the elements liberated by the electrolysis and a reactive body. A preferred aspect of the invention provides an aqueous electrolytic vat in which the hydrogen liberated at the cathode is reacted with liquid sodium giving sodium hydride and the oxygen liberated at the anode is reacted with barium oxide, either as a liquid or a fluidized solid, to give barium peroxide.

2 Claims, 4 Drawing Figures

METHOD OF ELECTROLYSIS

This is a continuation-in-part of U.S. Ser. No. 569,773, filed Apr. 21, 1975, now abandoned.

The present invention concerns a method of electrolysis in which the electric energy necessary for the electrolytic decomposition is at least partially drawn from the calorific energy released by chemical reactions using the elements resulting from this decomposition.

In the existing state of the art, the electric supply to electrolytic vats has been achieved by means of a completely separate source of electric energy. The present invention aims at providing an electrolytic vat installation, in which exothermic chemical reactions occur at the electrodes and the released energy is recuperated and converted into low-voltage continuous electric energy.

Consequently, in accordance with the present invention, the new method of electrolysis is characterized in that at least one of the elements resulting from the electrolytic decomposition is combined with a reactive body such that heat is released when the combination takes place, the released heat is recovered and then converted into electric energy which is used for supplying the continuous low-voltage electric energy necessary for electrolysis.

The conversion of calorific energy into electric energy is carried out in a thermodynamic cycle comprising a cold source and a hot source, the hot source being constituted by the electrolytic vat which releases calorific energy during the exothermic reaction of one of the gases resulting from electrolysis and the reactive body. Since the yield from the process of electrolysis is increased if the temperature of the electrolytic bath rises, the invention provides for the use, as the cold source, of one of the constituents of the electrolytic bath before it has been introduced into the vat, so as to increase its temperature.

The invention is particularly useful when applied to the electrolysis of water, in which the electrolytic bath is conventionally constituted by a dilute aqueous solution of a salt, a base or an acid. The water that has to be continuously supplied to the vat at the same rate as that at which is decomposes into hydrogen and oxygen will be the liquid used as the cold source in said thermodynamic cycle.

In the attached drawings,

FIG. 3 shows an enlarged partial cross-section of an electrode used in the vat of FIGS. 2 and 3.

Figure 1:
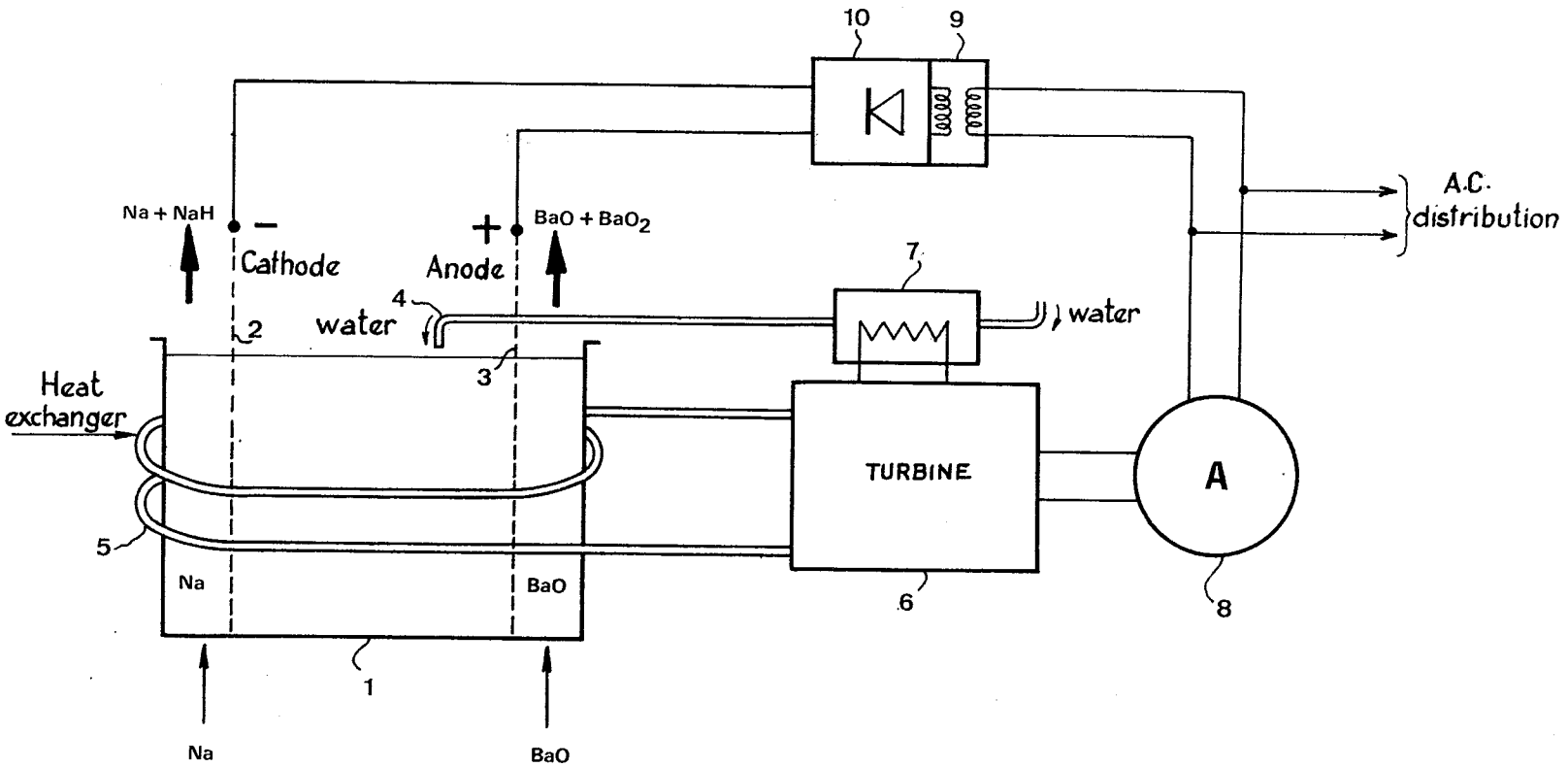
FIG. 1 illustrates diagrammatically the method of electrolysis in accordance with the invention, applied in the case of the electrolysis of water involving the release of hydrogen and oxygen, the hydrogen being combined with liquid sodium, and the oxygen with barium oxide.

Referring to FIG. 1, an electrolysis vat 1, shown diagrammatically, comprises a porous cathode 2 and a porous anode 3, and the part of the vat disposed between these two electrodes constitutes the electrolytic bath whereas the part situated on the other side of the porous electrodes is used for releasing the gases of the electrolytic decomposition and for reacting them with reactive bodies brought into contact with these porous electrodes.

It is possible to imagine an arrangement other than that of a vat with porous electrodes, but the advantage of the latter is that they result in a more compact arrangement.

In the present case the electrolyte is an aqueous solution of KOH (35% KOH, 65% $H_2O$ by weight, for example) and the water is continuously supplied to the vat through a pipe 4.

A stream of molten sodium is caused to circulate at the exterior of the porous cathode 2, the sodium constituting the reactive body referred to above and combining immediately at the cathode with the hydrogen released by electrolysis to provide sodium hydride, NaH. The sodium hydride is liquid and therefore enables the hydrogen to be recovered in compact form, with lowering of the partial hydrogen pressure in the vat due to the immediate elimination of the gazeous form of hydrogen, so that the voltage necessary for supplying the vat is reduced according to the formula $$E = Eo + \frac{RT}{2F} \frac{\log p\,H_2 \sqrt{p\,O_2}}{p\,H_2O}$$

$pH_2$ $pO_2$, $pH_2O$ are the partial pressures of hydrogen, oxygen and water respectively; T is the temperature, F is Faraday constant and R the universal constant of gaz. Eo is a constant and E is the potential of electrodes.

It can be seen that reducing $pH_2$ and $pO_2$ by transforming $H_2$ into NaH and $O_2$ into Ba $O_2$ leads to a reduced voltage supply required for a given current.

In order to effectively reduce the partial pressures of hydrogen and oxygen, these two gases are made to combine rapidly with reactive bodies.

Consequently there are two reasons why sodium is utilized to react with hydrogen as soon as possible after hydrogen has appeared at the cathode: firstly the reaction is exothermic and the heat can be retrieved to produce energy, secondly the reaction leads to a reduction of the partial pressure of hydrogen, and therefore to a reduction of the electrical energy necessary to the electrolysis.

For the same reasons, the oxygen released at the anode is made to combine rapidly with barium oxide BaO to produce exothermically barium peroxide $BaO_2$ which is solid and therefore leads also to a diminution of the partial pressure of oxygen.

A stream of barium oxide BaO in liquid form or in the form of a fluidized bed is caused to circulate at the exterior of the porous anode 3.

In the invention, use is made of the fact that the reactions of combinations of, on the other hand, hydrogen with sodium and, on the other hand, of barium oxide with oxygen are exothermic at the operating temperatures of the electrolytic vat, which temperatures are in the range of 200° C to 400° C. A heat-exchanger 5 recovers the released heat and passes it to a fluid which is supplied to a turbine 6 to cause it to rotate. The fluid may be water-vapour. To ensure that the turbine 6 operates efficiently, there is provided a cold source constituted by water circulated in a heat-exchanger 7. While the turbine is operating, the temperature of the water circulating in the heat-exchanger 7 rises, and this water is passed to the electrolysis vat through the pipe 4. The rise in the temperature of the vat, resulting from water being passed into the thermodynamic cycle of the turbine 6, is a factor leading to an improvement in the yield of the electrolysis operation.

The turbine 6 drives an alternator 8 which supplies electric energy that can be used for providing the electrolytic vat with continuous voltage after transformation in a voltage reducer 9 and a rectifying means 10.

The aim of the electrolysis is to obtain hydrogen and oxygen. Thus, to recover hydrogen from the sodium hydride, and oxygen from the barium peroxide, decomposition by heating can be carried out later, for example, by means of a high-temperature nuclear reactor. Before this decomposition, oxygen and hydrogen are stored in compact form: $BaO_2$ and NaH.

Numerous advantages are offered by the method in accordance with the present invention, namely:

The electrolytic vat may be of compact form, particularly if electrodes are porous as described below in the preferred embodiment.

The elements resulting from the combination of hydrogen and of oxygen with reactive bodies, (sodium and barium oxide) are also of compact form since they are either liquids (NaH) or solids ($BaO_2$), and they can be transported from the place where they are produced to the place where they are to be used, in particular, sodium hydride can be used directly for certain industrial applications.

If sodium hydride and barium peroxide are decomposed in situ or not far from the place where they are produced, it is possible to recover the sodium and the barium oxide which then circulate continuously in the porous electrodes.

The hydrogen and the oxygen resulting from the decomposition of NaH and $BaO_2$ are completely separated.

The preferred embodiment of the electrolysis vat will now be described with reference to FIGS. 2 and 3.

Figure 2:
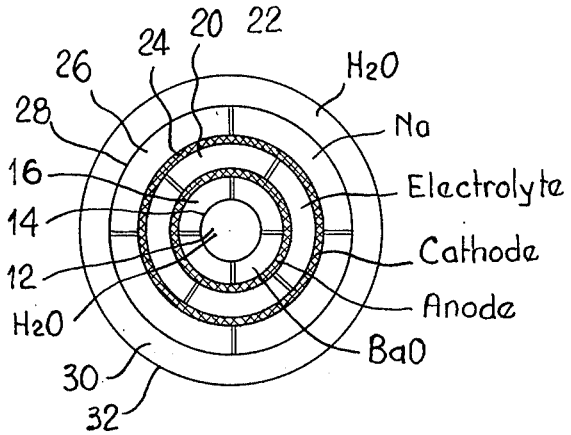
FIG. 2 shows a transverse cross-section of a preferred embodiment of vat for use in the method according to the invention.
Figure 3:
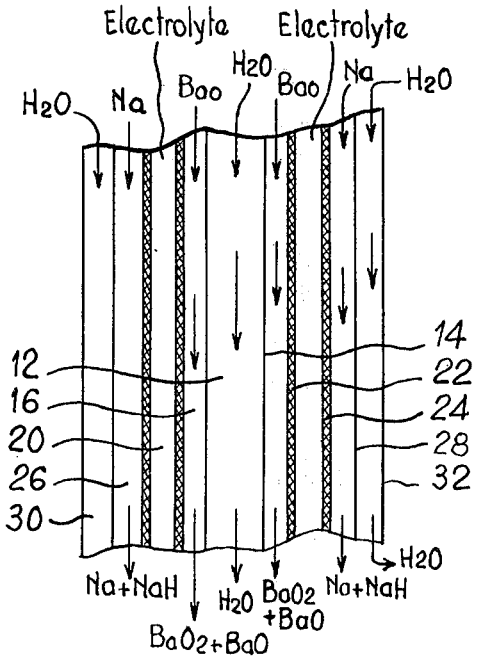
FIG. 3 shows a longitudinal cross-section of the vat of FIG. 2.

FIG. 2 shows a transverse cross-sectional view of the vat which is in the form of an elongated cylinder with concentrical electrodes, and FIG. 3 shows a longitudinal cross section of the same.

The cylindrical vat has a length of approximately one meter, and a total diameter of a few centimeters.

It is composed of five chambers which are successively:

a chamber 12 for the circulation of steam for recuperating heat released by the reaction $BaO + \frac{1}{2} O_2 \rightarrow BaO_2$. This chamber is limited by a cylindrical wall 14 made of aluminium or an aluminium alloy.

an annular chamber 16 surrounding wall 14, for the circulation of BaO. This chamber is itself surrounded by the porous anode 22 which is mainly made of nickel as will be explained with reference to FIG. 4.

an electrolyte chamber 20 between anode 22 and cathode 24. Cathode 24 is porous and also made mainly of nickel.

a chamber 26 for circulation of Na, around porous cathode 224. This chamber is outwardly limited by a cylindrical wall 28 in a metal capable of resisting Na and NaH at a temperature of about 400° C.: for instance stainless steel with high nickel and chromium contents, and very low carbon content, such as Incoloy (46%) Fe, 32% Ni, 20% Cr).

a chamber 30 for circulation of steam for recuperation of heat produced by the reaction $Na + \frac{1}{2} H_2 \rightarrow NaH$ in chamber 26. This chamber is limited by an external wall 32, preferably made of aluminium.

The chambers are individually divided into compartments by radial spacing walls, which maintain the various annular walls and electrodes concentric to each other.

The dimensions have been chosen for a typical intensity of electrolysis current of about 1 Amp/cm$^2$ of electrode. This makes approximately 0,2 cm$^3$/s of hydrogen (evaluated at normal conditions of 0° C and 1 bar) and therefore 0,3 mm$^3$/s of NaH per cm$^2$ of electrode.

An annular interval of about 2 to 3 mm between cathode 24 and wall 28 has been chosen so that the produced NaH can be evacuated easily, with a current of liquid sodium falling by gravity at a few meters/-second.

Between wall 14 and anode 22, chamber 16 has an annular width of about 5 mm to permit recuperation of solid $BaO_2$ without jamming.

The central chamber 12 has a diameter of about 15 mm and the circulation of steam inside it is such as to provide a temperature drop of 50° C between the ends of the tube: for instance steam is circulated at a pressure of 35 bars and with a speed of 5 to 6 meters per second (0.6 liters/sec).

Figure 4:
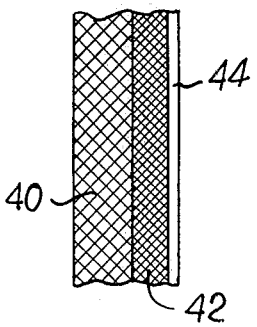

The structure of the porous electrodes will now be described with reference to FIG. 4 which shows an enlarged view of a portion of electrode.

They are made of three superposed porous layers which are respectively:

a layer 40 constituted of sintered nickel having a texture of relatively large grains (50 to 200 microns diameter, which gives pores of about 50 to 80 microns width). This layer 40 ensures the mechanical solidity of the electrode.

a layer 42 constituted of sintered nickel of a closer texture: grains and pores about 8 to 15 times smaller than in layer 40. This layer insures that no liquid from the electrolyte side or from the Na or BaO side can go through the electrode: the pores are made small enough so that passage by capillarity is prevented.

a layer 44 constituted of a thin nickel layer which is soldered on the sintered layer 42 and which is also porous: pores are mechanically drilled in this layer and these pores have approximately dimensions of the order of 50 microns; they may be of a conical or cylindrial shape. This layer 44 is in contact with the electrolyte.

The dimensions of the layer are preferably 5 mm for layer 40, 1 mm for layer 42 and 0.1 mm for layer 44.

Both electrodes of the vat of FIGS. 2 and 3 can be made on this model.

What I claim is:

1. A method for the electolysis of water in which the electrolyte is an aqueous solution of an acid, base or salt, wherein hydrogen resulting from electrolytic decomposition is combined with a current of sodium to form sodium hydride and the oxygen resulting from the electrolytic decomposition is combined with an alkaline earth metal oxide to form an alkaline earth metal peroxide, or hyperoxide, and wherein the heat released by these combinations is converted into electric energy which is used for supplying part of the low voltage electric energy necessary for the electrolysis.

2. A method as claimed in claim 1 wherein the alkaline earth metal oxide is barium oxide.

* * * * *